US006859999B2

(12) United States Patent
Huber et al.

(10) Patent No.: US 6,859,999 B2
(45) Date of Patent: Mar. 1, 2005

(54) METHOD FOR MANUFACTURING A POWER CHIP RESISTOR

(75) Inventors: Louis P. Huber, Valencia, CA (US); Ziv Shoshani, Tel-Aviv (IL)

(73) Assignee: Vishay Techno Components, LLC, Ontario (CA)

( * ) Notice: Subject to any disclaimer, the term of this patent is extended or adjusted under 35 U.S.C. 154(b) by 38 days.

(21) Appl. No.: 10/091,792

(22) Filed: Mar. 6, 2002

(65) Prior Publication Data

US 2002/0130760 A1 Sep. 19, 2002

Related U.S. Application Data

(62) Division of application No. 09/811,844, filed on Mar. 19, 2001.

(51) Int. Cl.[7] ..... H01C 17/00

(52) U.S. Cl. ..... 29/610.1; 29/611; 29/619; 29/620; 29/621; 174/260; 338/308; 338/309; 338/332; 430/313; 430/315; 430/324; 438/462; 438/977

(58) Field of Search ..... 29/610.1, 611, 29/619, 620, 621, 612; 174/260; 338/308, 309, 332; 430/313, 315, 324; 438/462, 977; 333/172

(56) References Cited

U.S. PATENT DOCUMENTS 4,267,634 A * 5/1981 Wellard ..... 29/620
5,519,176 A * 5/1996 Goodman et al. ..... 174/255
5,562,973 A * 10/1996 Nagasaka et al. ..... 428/210
6,124,769 A * 9/2000 Igarashi et al. ..... 333/172
6,194,990 B1 * 2/2001 Lee et al. ..... 338/320
6,311,390 B1 * 11/2001 Abe et al. ..... 29/612
6,314,637 B1 * 11/2001 Kimura et al. ..... 29/620

FOREIGN PATENT DOCUMENTS

| | | | |
|---|---|---|---|
| DE | 40 30 479 A 1 | 4/1992 | |
| JP | 63296201 | 12/1988 | |
| JP | 06-283301 | * 10/1994 | ..... H01C/7/00 |
| JP | 11016703 | 1/1999 | |
| WO | WO 98/38652 | 3/1998 | |
| WO | WO 99/53505 | * 10/1999 | ..... H01C/7/13 |

* cited by examiner

*Primary Examiner*—Carl J. Arbes
*Assistant Examiner*—Tim Phan
(74) *Attorney, Agent, or Firm*—McKee, Voorhees & Sease, P.L.C.

(57) ABSTRACT

The invention provides for a method of manufacturing a stacked power chip resistor. The method includes adhering a first chip resistor to a second chip resistor with a glass encapsulant, connecting a first terminal of the first chip resistor to a first terminal of the second chip resistor with the first metal barrier, and connecting a second terminal on the first chip resistor to a second terminal of the second chip resistor with a second metal barrier.

5 Claims, 4 Drawing Sheets

METHOD FOR MANUFACTURING A POWER CHIP RESISTOR

This application is a Divisional of U.S. patent application Ser. No. 09/811,844 filed on Mar. 19, 2001.

BACKGROUND OF THE INVENTION

A. Field of the Invention

This invention relates to power chip resistors. More specifically the invention relates to an improved power chip resistor with increased power dissipation in a small package.

B. Problems in the Art

Power resistors, chip resistors, and power chip resistors have numerous applications in electronic circuits including limiting current. The problem of limiting current or otherwise using a power chip resistor is sometimes in conflict with the amount of board space that can be allocated for the resistor. In order to increase the power dissipation of a chip resistor, the size of the resistor is increased. As electronic devices continue to decrease in size, board space and the need to reduce board space increases. Thus there is a problem in using a power chip resistor when there is limited board space.

Some attempts have been made at stacking chip resistors. A stacked chip resistor would reduce the amount of board space required as the size of the resistor would increase vertically. These attempts have created additional problems.

One such problem is that these attempts have used epoxy or other resins or polymers as an adhesive to physically connect each chip resistor in the stack. Epoxy is widely used as an adhesive in the art but has certain qualities that make it ineffective for stacking power chip resistors. In particular, long term use of epoxy or other polymers in a power chip resistor may result in an electrical instability effect over time due to the effects of resistive heating.

Another problem relates to the use of solder at the terminals of a stacked chip resistor. The magnitude of the resistive heating can be so great, particularly in high wattage power chip resistors, that when stacked, the solder melts. Because solder would melt, the power chip resistor would not be compatible with standard manufacturing practices and methods concerning population of components on a circuit board. In particular, standard flowing processes could not be used as the power chip resistor would not be flow solderable. Thus any accommodation of a power chip resistor into a circuit design would involve additional manufacturing costs.

It is therefore an objective of the present invention to provide an apparatus and method of making a power chip resistor that improves upon the state of the art.

It is a further objective of the present invention to provide a power chip resistor and method of making a power chip resistor that permits a power chip resistor to be made that requires reduced circuit board space.

It is a further objective of the present invention to provide a power chip resistor and method of making a power chip resistor that provide the capability of increased power dissipation.

It is a further objective of the present invention to provide a power chip resistor and method of making a power chip resistor that provide for stacking power chip resistors.

It is a further objective of the present invention to provide a power chip resistor and method of making a power chip resistor that provides for a resistor with a higher power rating.

It is a further objective of the present invention to provide a power chip resistor capable of use at high voltages.

It is a further objective of the present invention to provide a power chip resistor that may be surface mounted.

It is a further objective of the present invention to provide a power chip resistor that is stable over time.

It is a further objective of the present invention to provide a power chip resistor that does not melt a solder connection.

It is a further objective of the present invention to provide a power chip resistor that uses a thick film resistant element.

It is a further objective of the present invention to provide a power chip resistor that is flow solderable.

It is a further objective of the present invention to provide a power chip resistor that reduces manufacturing costs.

These and other objectives will become apparent from the following description.

SUMMARY OF THE INVENTION

The following disclosure describes a power chip resistor that is capable of requiring reduced board space and increased power dissipation. The invention provides for the stacking of a number of chip resistors in order to construct a power chip resistor with increased power dissipation while not needing to increase the amount of board space occupied by the resistor. The invention uses an inert encapsulant such as glass to separate power chip resistors and uses a plating on the ends of the power chip resistor such as nickel so that solder will not melt.

DETAILED DESCRIPTION OF AN EXEMPLARY EMBODIMENT

Figure 1:
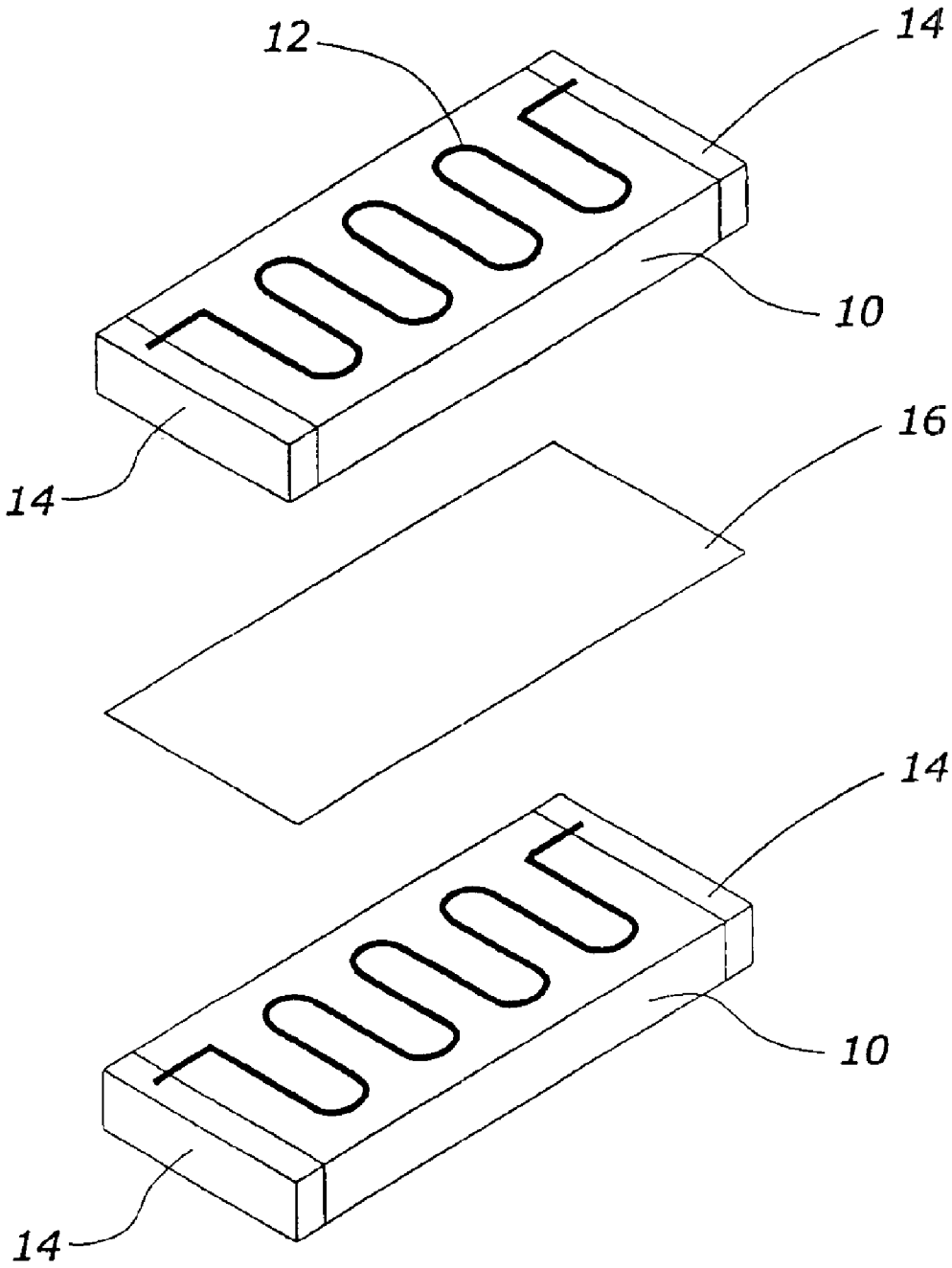
FIG. 1 is an exploded view of the power chip resistor of the present invention having a stack of two chip resistors.

FIG. 1 is a diagram showing an exploded view of the power chip resistor of the present invention. In FIG. 1, two chip resistors 10 are shown. Each power chip may be of an internationally standard size although the present invention contemplates custom sizes as well. Each chip resistor is a thick film power chip resistor. The thick film power chip resistor has a resistive element 12. This resistive element is a thick film resistive element and preferably is ruthenium oxide. The thick film resistor preferably has an alumina substrate. The present invention is not limited to the particular type of film resistor and the present invention contemplates that other types of material may be used for the resistive element and for the substrate.

Each power chip resistor 10 also has electrical terminals or end caps 14. The terminals or end caps are of palladium silver or other conductor or metal or metal alloy that is known in the art.

Between each power chip resistor 10 is a layer of glass frit 16. The present invention contemplates that an encapsulant such as glass or other inert material may be used. The encapsulant provides the advantage of insulating the power chip resistor 10 without concern for long term instability such as may be caused by resistive heating.

Figure 2:
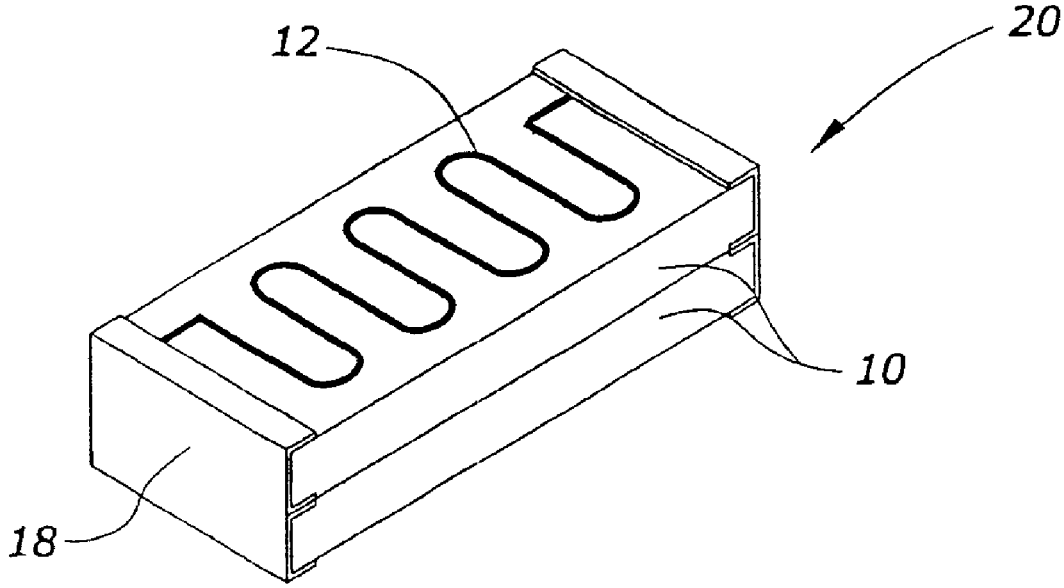
FIG. 2 is a diagram of the power chip resistor of the present invention having a stack of two chip resistors

FIG. 2 best shows a stacked power chip resistor 20 of the present invention. Once the power chip resistors 10 have the layer of encapsulant 16 in place, a nickel barrier 18 is used. The nickel barrier plates the end caps 14. The nickel barrier provides for both electrical and mechanical connection of the power chip resistors within the stack. The nickel plating is conductive so that the nickel plating ensures electrical connections between the corresponding terminals of each power chip resistor that is stacked. Each power chip resistor in the stack is electrically in parallel with the other power chip resistors in the stack. The nickel plating also serves to mechanically bond together the power chip resistors in the stack so that there is mechanical stability even though epoxy or other adhesive is not used.

Nickel is preferred due to its high specific heat capacity. The high specific heat capacity of the nickel plating allows additional heat to be absorbed by the stacked power chip resistor and leads to higher power ratings. The present invention contemplates that other conductors with high specific heat capacity could be used as suggested by the particular application and specifications for a particular use. The use of nickel instead of solder precludes melting of the plating and end caps at higher temperatures and higher power levels.

Figure 3:
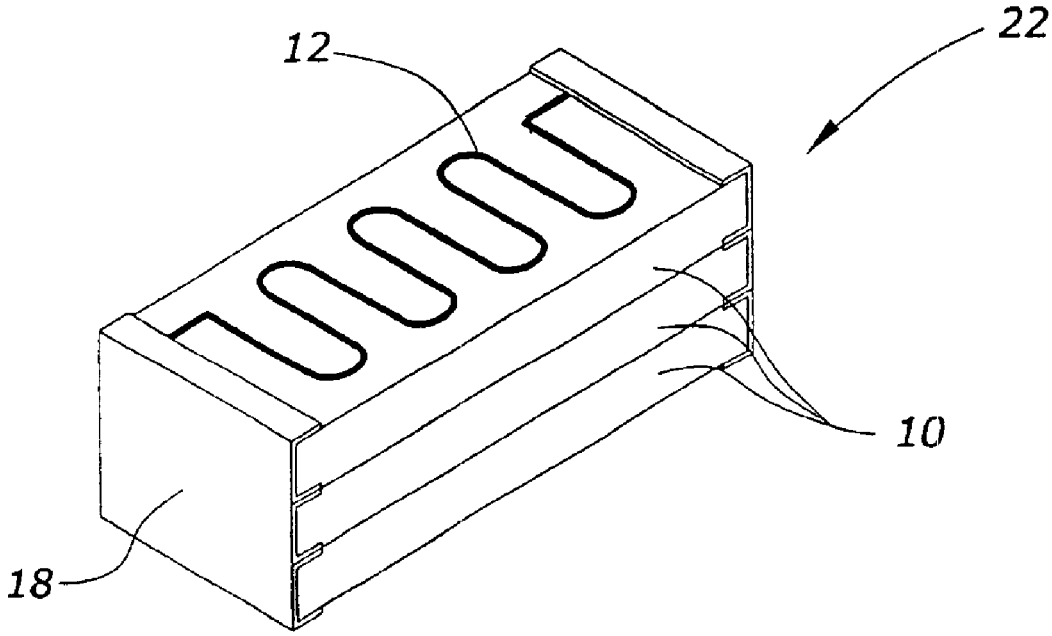
FIG. 3 is a diagram of the power chip resistor of the present invention having a stack of three chip resistors.
Figure 4:
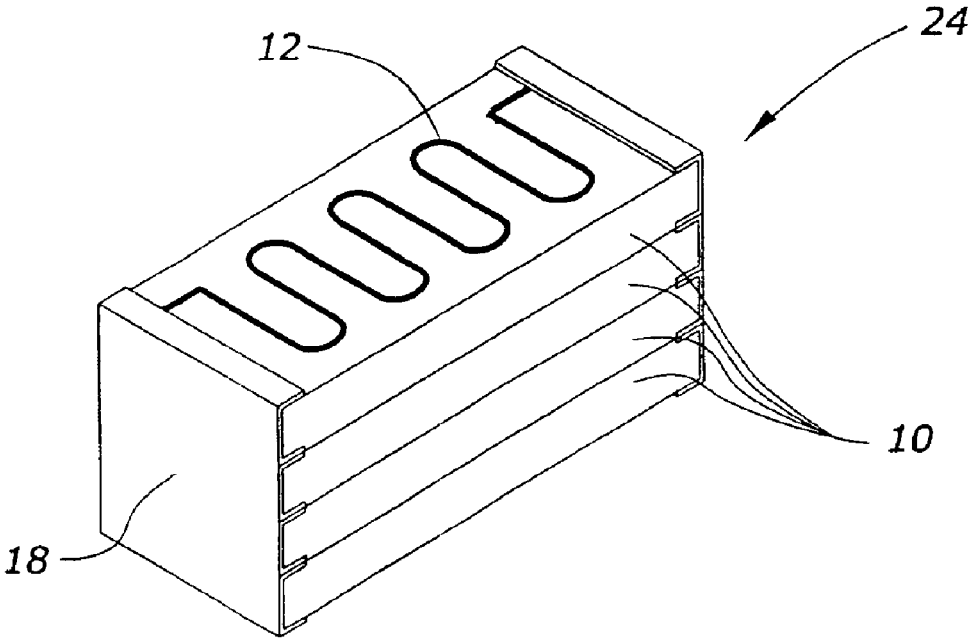
FIG. 4 is a diagram of the power chip resistor of the present invention having a stack of four chip resistors.

As shown in FIG. 3, the present invention contemplates variations in the number of power chip resistors that are stacked. FIG. 3 shows a triple stack power chip resistor 22. FIG. 4 shows a quadruple stacked power chip resistor 24. By increasing the number of power chip resistors that are stacked, the size of the stacked power chip resistor increases without requiring additional board space. This increase in size also increases the amount of heat that can be dissipated by the power chip resistor and thus increases the power range of the resistor. This increase in power range is approximately proportional to the increase in size of the power chip resistor.

When stacked, the size of the stacked power chip resistor need only change in thickness. Thus for example, in one standard size used in surface mount components, the length of the power chip resistor is 0.250 inches as measured from barrier to barrier. The width of the stacked power chip resistor is 0.056 inches and the thickness of the stacked power chip resistor is dependent upon the number of power chip resistors in the stack. Thus a double stack resistor would have a thickness of 0.056 inches, a triple stack would have a thickness of 0.085 inches, and a quadruple stack would have a thickness of 0.114 inches. These sizes are given by way of example only, to show that the amount of board space required is independent of whether the stacked power chip resistor is double stacked, triple stacked, or quadruple stacked. The present invention contemplates any size such as may be an international standard or that may be a custom size.

The present invention also contemplates operation over a wide range of resistance ranges, power ranges, and voltage ratings and is in no way limited by the particular choice of these specifications, as these specifications may be suggested by a particular environment or use.

Thus, an apparatus and method for a power chip resistor has been disclosed. It will be readily apparent to those skilled in the art that the present invention fully contemplates variations in the stacking of multiple power chip resistors, the choice of materials, and other modifications in the present invention.

What is claimed is:

1. A method of manufacturing a stacked power chip resistor that increases the amount of heat dissipated without requiring additional board space comprising:

separating a first chip resistor from a second chip resistor with a glass encapsulant, each chip resistor comprising a substrate, a resistive element on the substrate and first and second end caps electrically connected to opposite ends of the resistive elements;

connecting the first end cap of the first resistor and the first end cap of the second resistor with a first barrier to mechanically connect the first and second chip resistors to provide long term mechanical stability in a manner resistant to resistive heating;

connecting the second end cap of the first resistor and the second end cap of the second resistor with a second barrier to mechanically connect the first and second chip resistors to provide long term mechanical stability in a manner resistant to resistive heating.

2. The method of claim 1 wherein each substrate is an alumina substrate.

3. The method of claim 1 wherein each resistive element is a ruthenium oxide resistive element.

4. The method of claim 1 wherein the first chip resistor and the second chip resistor are each of a standard size of approximately 0.250 inches in length.

5. The method of claim 1 wherein the first and second metal barrier comprise nickel plating.

* * * * *